US006080302A

United States Patent [19]

Aldous et al.

[11] Patent Number: 6,080,302

[45] Date of Patent: Jun. 27, 2000

[54] METHOD FOR MAKING A PROCESS OIL BY USING AROMATIC ENRICHMENT WITH EXTRACTION FOLLOWED BY SINGLE STAGE HYDROFINISHING (LAW764)

[75] Inventors: Keith K. Aldous, League City; Jacob Ben Angelo, Spring, both of Tex.; Joseph Philip Boyle, Baton Rouge, La.

[73] Assignee: Exxon Research and Engineering Co., Florham Park, N.J.

[21] Appl. No.: 09/212,036

[22] Filed: Dec. 15, 1998

Related U.S. Application Data

[63] Continuation-in-part of application No. 08/920,554, Aug. 29, 1997, Pat. No. 5,840,175.

[51] Int. Cl.[7] ..... C10G 1/04

[52] U.S. Cl. ..... 208/87; 208/264; 208/210; 208/316; 208/301; 208/302; 208/45; 208/89; 208/211; 208/16; 208/14

[58] Field of Search ..... 208/14, 83, 264, 208/301, 302, 45, 89, 211, 19

[56] References Cited

U.S. PATENT DOCUMENTS

| | | | |
|---|---|---|---|
| 3,732,154 | 5/1973 | Mills et al. | 208/14 |
| 4,801,373 | 1/1989 | Corman et al. | 208/210 |
| 5,736,611 | 4/1998 | Blok et al. | 525/305 |
| 5,840,175 | 11/1998 | Aldous et al. | 208/87 |

*Primary Examiner*—Helane Myers

[57] ABSTRACT

A method for producing a process oil is provided in which an aromatic extract oil is added to a paraffinic rich feed to provide a blended feed. The blended feed is then extracted with an aromatic extraction solvent to yield a raffinate which subsequently is hydrotreated to provide a process oil.

14 Claims, No Drawings

METHOD FOR MAKING A PROCESS OIL BY USING AROMATIC ENRICHMENT WITH EXTRACTION FOLLOWED BY SINGLE STAGE HYDROFINISHING (LAW764)

CROSS REFERENCE TO RELATED APPLICATION

This application is a Continuation-in-Part of U.S. application Ser. No. 920,554, filed Aug. 29, 1997, now U.S. Pat. No. 5,840,175.

FIELD OF THE INVENTION

The present invention is concerned generally with the production of process oils from paraffinic rich feeds.

BACKGROUND OF THE INVENTION

The properties of paraffinic rich feeds make them particularly useful in a broad range of oils used in a wide variety of industrial applications. For example, the paraffinic oils may be used in rubber processing for reasons such as reducing the mixing temperature during the processing of the rubber, and preventing scorching or burning of the rubber polymer when it is being ground down to a powder, or modifying the physical properties of the finished rubber. These oils are finished by a refining procedure which imparts to the oils their excellent stability, low staining characteristics and consistent quality.

End-users of such process oils desire oils with increased solvency as indicated by a lower aniline point. Accordingly, one object of the present invention is to provide a process oil that has a lower a aniline point and consequently increased solvency above what could be obtained from paraffinic distillates alone, by using paraffinic distillates in admixture with their co-produced extracts.

Due to the decline in the availability of conventional naphthenic feeds, paraffinic distillates are being substituted for portions or all of some naphthenic distillates since the demand for higher solvency process oils is still increasing. Accordingly, it is another object of the present invention to provide process oils with increased solvency using lesser amounts of paraffinic rich feeds.

SUMMARY OF THE INVENTION

A method for producing a process oil is provided which comprises:

- adding an aromatic containing extract oil to a paraffinic rich feed to provide a blended feed for processing;
- extracting the blended feed with an aromatic extraction solvent at temperatures in the range of about 50° C. to about 150° C. and at solvent to feed ratios in the range of about 0.5:1 to about 3:1 by volume to obtain a raffinate for hydrofinishing;
- and then hydrotreating the raffinate in a hydrotreating stage maintained at a temperature of about 275° C. to about 375° C., a hydrogen partial pressure of about 300 to about 2500 psia, and at a space velocity of about 0.1 to about 2.0 v/v/hr to provide a process oil.

These and other embodiments of the present invention will become apparent after a reading of detailed description which follows.

DETAILED DESCRIPTION OF THE INVENTION

Typically the paraffinic rich feed used to produce process oils in accordance with the method of the present invention will comprise virgin and/or synthenic hydrocarbons, although other paraffinic rich materials obtained by extraction or alkane or ketone dewaxing, catalytic dewaxing and the like may be utilized.

In accordance with the present invention, an aromatic extract oil is added to the paraffinic rich feed to provide a blended feed for hydrotreating. Preferably the aromatic extract oil used in the present invention will have an aniline point less than about 60° C. for high viscosity oils (e.g., greater than about 35 cSt @ 100° C.) and less than about 70° C. for low viscosity oils (e.g., about 2 cSt to about 35 cSt @ 100° C.).

Such an aromatic oil suitable in the process of the present invention is readily obtained by extracting a naphthenic or paraffinic rich feed such as a distillate with aromatic extraction solvents at temperatures in the range of about 50° C. to about 150° C. in extraction units known in the art. Typical aromatic extraction solvents include N-methylpyrrolidone, phenol, N-N-dimethylformamide, dimethylsulfoxide, methylcarbonate, morpholine, furfural, and the like and preferably N-methylpyrrolidone or phenol. Solvent to oil treat ratios are generally about 0.5:1 to about 3:1. The extraction solvent preferably contains water in the range of about 1 vol. % to about 20 vol. %. Basically the extraction can be conducted in a counter-current type extraction unit. The resultant aromatic rich solvent extract stream is then solvent stripped to provide an aromatic extract oil having an aromatic content of about 50% to 90% by weight.

The aromatic extract oil is mixed with the same or different viscosity paraffinic rich feed in an extract to feed volume ratio in the range of about 10:90 to about 90:10, preferably 25:75 to 50:50. Typical but not limiting examples of paraffinic feed and extract oils are provided in Tables 1 and 2 for low and high viscosity oils, respectively.

TABLE 1

LOW VISCOSITY PARAFFINIC FEED AND EXTRACT OIL - 75N

| | Paraffinic Feed | Extract Oil |
|---|---|---|
| Physical Properties (Waxy) | | |
| Density, 15° C. | 0.8866 | 0.9332 |
| Calc Viscosity cSt @ 100° C. | 3.2 | 3.6 |
| Refractive Index @ 75° C. | 1.4713 | 1.5021 |
| Aniline Point, ° C. | 81.3 | 53.0 |
| Pour Point, ° C. | 21.0 | 12.0 |
| Sulfur, wt. % | 1.2 | 2.0 |
| Dewaxed Viscosity Index @ −9° C. Pour | 71 | N/A* |
| Compositional Properties (Waxy) | | |
| Saturates, wt. % | 62 | 44 |
| Polars & Aromatics, wt. % | 38 | 56 |

*Viscosity Index of coproduced raffinate at −9° C. pour is 95

TABLE 2

HIGH VISCOSITY PARAFFINIC FEED AND EXTRACT OIL - 600N

| | Paraffinic Feed | Extract Oil |
|---|---|---|
| Physical Properties (Waxy) | | |
| Density 15° C. | 0.9327 | 0.9670 |
| Viscosity, cSt @ 100° C. | 17.7 | 42.2 |
| Refractive Index @ 75° C. | 1.5036 | 1.5511 |
| Aniline Point, ° C. | 90.3 | 44.0 |
| Pour Point, ° C. | 48.0 | 6.0 |

TABLE 2-continued

| HIGH VISCOSITY PARAFFINIC FEED AND EXTRACT OIL - 600N | | |
|---|---|---|
| | Paraffinic Feed | Extract Oil |
| Sulfur, wt. % | 1.7 | 3.0 |
| Dewaxed Viscosity Index @ −9° Pour | 39 | N/A* |
| Compositional Properties (Waxy) | | |
| Saturates, wt. % | 42 | 17 |
| Polars & Aromatics, wt. % | 58 | 83 |

*Viscosity Index of coproduced raffinate at −9° C. pour is 100

The resultant mixture is then subjected to a solvent extraction using aromatic extraction solvents such as those previously described in connection with obtaining the aromatic extract oil for blending, but under generally milder conditions. Thus, for example, in extracting the blended feed the ratio of solvent to blended feed is generally in the range of about 0.5:1 to about 3:1 and the extraction is conducted at a temperature in the range of about 50° C. to about 150° C. and the extraction solvent contains water in the range of about 1 vol % to about 20 vol %; and preferably greater than about 5 vol % to produce a raffinate.

The resultant raffinate is then subjected to a hydrotreating step in a single hydrotreating stage which is maintained at a temperature in the range of about 275° C. to about 375° C. and preferably within the range of 340° C. to 365° C. at a hydrogen partial pressure in the range of about 300 to about 2500 psia and preferably from 500 to 1200 psia. Hydrotreating is conducted at a liquid hourly space velocity in the range from about 0.1 to about 2.0 v/v/hour and preferably from 0.5 to 1.0 v/v/hour.

The hydrotreating is effected conventionally under hydrogen pressure and with a conventional catalyst. Catalytic metals such as nickel, cobalt, tungsten, iron, molybdenum, manganese, platinum, palladium, and combinations of these supported on conventional supports such as alumina, silica, magnesia, and combinations of these with or without acid-acting substances such as halogens and phosphorous may be employed. A particularly preferred catalyst is a nickel molybdenum phosphorus catalyst supported on alumina, for example KF-840.

An optional dewaxing step could be conducted on the paraffinic rich feed or the hydrofinished product using catalytic dewaxing or alkane or ketone or catalytic dewaxing.

What is claimed is:

1. A method for producing a process oil comprising:

adding an aromatic extract oil to a paraffinic rich feed to provide a blended feed;

extracting the blended feed with an aromatic extraction solvent at a temperature of from about 50° C. to about 150° C. and a solvent to feed ratio of about 0.5:1 to about 3:1 to obtain a raffinate for hydrotreating;

hydrotreating the raffinate in a single hydrotreating stage at a temperature of about 275° C. to about 375° C. and a hydrogen partial pressure of about 300 to about 2500 psia at a space velocity of about 0.1 to about 2.0 v/v/hr whereby a process oil is produced.

2. The method of claim 1 wherein the aromatic extraction solvent contains from about 1 vol % to about 20 vol % water.

3. The method of claim 1 wherein the paraffinic rich feed is a paraffinic distillate.

4. The method of claim 3 wherein aromatic extract oil is added to the paraffinic feed in the volume ratio of about 10:90 to about 90:10.

5. The method of claim 4 wherein the volume ratio of aromatic extract oil to paraffinic feed is the range of 25:75 to 50:50.

6. The method of claim 5 wherein the extraction solvent contains greater than 5 vol % water.

7. The method of claim 6 wherein the aromatic extract oil has an aromatic content of about 50% to 90% by weight.

8. The method of claim 1 including dewaxing of the paraffinic rich feed or the hydrofinished oil using catalytic dewaxing or alkane or ketone dewaxing.

9. A method for producing a process oil comprising:

(a) solvent extracting a naphthenic rich feed with an aromatic extraction solvent to obtain an aromatic rich solvent stream;

(b) removing the solvent from the aromatic rich solvent stream to obtain an aromatic extract oil;

(c) adding the aromatic rich extract oil to a paraffinic rich feed to obtain a blended feed;

(d) extracting the blended feed under milder conditions than the extraction of step (a) with an aromatic extraction solvent at a temperature of about 50° C. to about 150° C., and a solvent to feed ratio of about 0.5:1 to about 3:1 to obtain a raffinate;

(e) hydrotreating the raffinate at a temperature in the range of about 275° C. to about 375° C., at a hydrogen partial pressure of about 300 to about 2500 psia at a space velocity of about 0.1 to about 2.0 v/v/hr.

10. The method of claim 9 wherein the aromatic extraction solvent of step (d) contains from about 1 vol % to about 20 vol % water.

11. The method of claim 10 wherein the solvent of contains greater than about 5 vol % water.

12. The method of claim 9 of step (c) wherein the volume ratio of aromatic extract oil to paraffinic feed in the blended feed is in the range of about 10:90 to about 90:10.

13. The method of claim 12 wherein the volume ratio of aromatic extract oil to paraffinic feed is in the range 25:75 to 50:50.

14. The method of claim 8 wherein the feed or hydrotreated raffinate oil is dewaxed using catalytic dewaxing or alkane or ketone or catalytic dewaxing.

* * * * *